US005596898A

United States Patent [19]

Drigani et al.

[11] Patent Number: 5,596,898

[45] Date of Patent: Jan. 28, 1997

[54] DEVICE FOR THE AXIAL CLAMPING/RELEASE OF THE CHOCKS OF THE ROLLS IN A ROLLING MILL STAND

[75] Inventors: Fausto Drigani, Zugliano; Pietro Morasca, Fresonara, both of Italy

[73] Assignee: Danieli & C. Officine Meccaniche SpA, Buttrio, Italy

[21] Appl. No.: 348,219

[22] Filed: Nov. 28, 1994

[30] Foreign Application Priority Data

Nov. 29, 1993 [IT] Italy ..... UD93A0237
Nov. 29, 1993 [IT] Italy ..... UD93A0238

[51] Int. Cl.[6] ..... B21B 28/00

[52] U.S. Cl. ..... 72/236; 72/237

[58] Field of Search ..... 72/236, 237, 238, 72/239, 245, 247; 384/397, 418

[56] References Cited

U.S. PATENT DOCUMENTS 4,905,494 3/1990 Frosch ..... 72/247

FOREIGN PATENT DOCUMENTS 483599 6/1992 European Pat. Off. ..... B21B 31/10
806182 2/1981 U.S.S.R. ..... 72/247
A88/08761 11/1988 WIPO ..... B21B 31/18

OTHER PUBLICATIONS

Patent Abstracts of Japan vol. 14, No. 26 (M–921) 18 Jan. 1990 & JP A 01 266 907 (Hitachi) 24 Oct. 1989–Abstract.

Patent Abstracts of Japan vol. 10 No. 191 (M–495) 4 Jul.1986 & JP A 61 037 307 (Hitachi) 22 Feb. 1986–Abstract.

Soviet Inventions Illustrated Sec. CH Week 9227 14 Sep. 1992 Derwent Pubs. Class M21, & Su A 1 667 969 7 Aug. 1991.

Soviet Inventions Illustrated Sec. CH week 9008, 4 Apr. 1990 Derwent Pubs. Class M 21 & SU A 1 502 146 (23 Aug. 1989).

Patent Abstracts of Japan vol. 10, No. 59 (M–459) 8 Mar. 1986 & JP A 60 206 508 (Hitachi Seisakusho) 18 Oct. 1985–Abstract.

Patent Abstracts of Japan vol. 10, No. 159 (M–486) 7 Jun. 1986) & JP A 61 014 008 (Yokohama Eirokuitsupu) 22 Jan. 1986–Abstract.

*Primary Examiner*—Lowell A. Larson
*Assistant Examiner*—Thomas C. Schoeffler
*Attorney, Agent, or Firm*—Antonelli, Terry, Stout & Kraus, LLP

[57] ABSTRACT

Device for the axial clamping/release of chocks (15) of working rolls (14) on a rolling mill stand, the rolling mill stand including an actuation side (10*a*-FIG. 1) and a working side (10*b*-FIG. 2), stationary housings (11) associated with stationary blocks (12) being comprised at the sides, each of the stationary blocks (12) being associated with a relative sliding block (13) positioned in a direction axial to the working rolls (14), each sliding block (13) defining a lodgement for a chock (15), the bearings of the working rolls (14) being lubricated with a centralized air-oil system which comprises a first part of connectors (22) located on the machine and fixed to supporting means (24) and a second part of connectors (17) included on the front of the relative chock (15), the sliding blocks (13) being associated, on the actuation side (10*a*), with oscillatory means (27) that clamp/release the sliding blocks (13) to/from the relative chocks (15), these oscillatory clamping/ releasing means (27) being able to move from a second position of releasing (FIG. 4) the chock (15) from the relative sliding block (13) to a first clamping position (FIG. 3), these clamping/releasing means (27) in their second releasing position acting on the means (24) that support the first part of the connectors (22) so as to clamp transversely the first part of the connectors (22) in a determined position coordinated axially with the position of the second part of the connectors (17).

7 Claims, 4 Drawing Sheets

DEVICE FOR THE AXIAL CLAMPING/RELEASE OF THE CHOCKS OF THE ROLLS IN A ROLLING MILL STAND

BACKGROUND OF THE INVENTION

This invention concerns a device for the axial clamping/release of the chocks of the rolls in a rolling mill stand.

To be more exact, the subject of this invention is embodied with a device which makes possible the quick and easy clamping and release, both on the working side and on the actuation side of the rolling mill stand, of the chocks bearing the working rolls to and from the relative sliding blocks providing axial displacement.

Moreover the device according to the invention makes possible a quick, easy and accurate connection and disconnection of the connectors feeding lubrication fluid to the bearings of the working rolls during the steps of changing the rolls.

The invention is applied advantageously, but not only, to rolling mill stands which process wide flat products and which require not only the normal reciprocal vertical positioning of the rolls but also a reciprocal axial displacement of the rolls so as to prevent hollows developing at given points in the circumference of the rolls owing to continuous wear.

Rolling mill stands have been disclosed which have their working rolls installed on chocks, which during working are secured axially to sliding blocks positioned between the chocks themselves and the stationary housings of the rolling mill stands.

Stationary blocks arranged axially to the rolls are generally included between the sliding blocks and the housings of the rolling mill stands.

Displacement means act on the sliding blocks and enable the working rolls to be displaced axially during the working steps.

The state of the art discloses various examples of systems of installation of the rolls on the relative chocks and of the chocks on the relative sliding blocks both on the actuation side and on the working side of the rolling mill stand, these systems ensuring a correct positioning of the rolls and the ability to obtain an accurate axial movement thereof.

JP-A-61-37307 discloses, for instance, a rolling mill stand in which the working rolls are associated with axial displacement means and in which an auxiliary thrust device is included which enables all the plays to be eliminated which are caused between the elements in reciprocal movement. This auxiliary device acts on the relative sliding block so as to ensure in an extremely accurate manner and under all operational conditions the correct desired axial displacement of the working rolls, thus obviating inaccuracies due to such plays.

SU-A-1,667,969 and SU-A-1,502,146 disclose a system for axial clamping of a chock to a relative sliding block, this system comprising an oscillatory lever element which can be momentarily disactivated during the step of changing the roll.

EP-A-483,599 discloses another example in which clamping lever means are included and are actuated, when the chock has been put in position, so as to clamp the chock axially to the sliding blocks.

One of the problems most often encountered in the state of the art arises from the modest size of the sliding blocks, or this size creates problems or the positioning of the sensors which monitor the open/closed positions or the lever elements.

The systems of the state of the art are therefore often devoid of the sensors, and this situation can entail problems of safety, control and speed of starting the working cycle of the rolling mill stand.

The sensors, when they are included, are positioned within the sliding blocks, with resulting problems during the step of acting on the sensors for cleaning, maintenance or replacement.

The problems linked to the changing of the working rolls are also found in this type of rolling stand. In fact, so as to change the rolls, it is necessary to release the chocks axially from the relative sliding blocks and to disconnect the connectors, which feed the lubricating fluid and which are included terminally and frontally on the chocks, from the connectors included on the machine.

During the step of fitting new rolls it is necessary first of all to align these connectors reciprocally and accurately so as to perform the coupling and then to secure the chocks axially to the sliding blocks.

A further problem is the fact that the chock during working has to be free to move also transversely to the sliding blocks, and this fact means also that the connectors included on the machine have to be able to follow the chock in its transverse movement.

This ability to make the connectors on the machine free to move transversely to the axis of the rolls entails problems of alignment and appropriate rotation of those connectors so that they will mate with the connectors on the chocks during the step of installation.

Moreover, the changing of the rolls has to be carried out in as short a time as possible so as not to involve long machine downtimes which could impair the output of the plant.

So as to avoid these problems and mainly to avoid the great losses of time due to the disconnection and successive connection of the lubricating connectors, it is the common practice in conventional rolling trains to use a grease lubrication system of a full fill-up type.

According to this lubrication system the bearings of the working rolls are filled with lubricating grease when the rolls are dismantled.

The rolls, when installed, are worked until the lubricating grease has been substantially all used up.

This lubricating system makes it possible not to have flexible connections on the machine and thus to eliminate the additional times and the alignment problems during installation which are due to the disconnection and successive re-connection of the hydraulic feeding connectors.

This system, however, is very expensive as compared to the centralised air-oil lubrication owing to the great quantity of lubricating grease which has to be employed. Moreover, it does not ensure a constant and balanced lubrication during the whole working cycle of the rolls.

SUMMARY OF THE INVENTION

The present applicants, with the purpose not only of ensuring a system for the quick axial clamping/release of the chocks to/from the sliding blocks, have therefore also the purpose of using a centralised lubrication system with feeder connectors located on the machine, this system not entailing additional times or problems during the step of changing the working rolls.

For this purpose the applicants have designed, tested and embodied this invention.

The purpose of the invention is to provide a device for the quick axial clamping/release, both on the actuation side and working side of the rolling mill stand, of the chocks bearing the working rolls to/from the relative sliding blocks.

The working side of the rolling mill stand is the side from which the chocks are normally withdrawn from the rolling mill stand, for instance during the step of changing the working rolls.

The actuation side of the rolling mill stand is instead the side on which are arranged the electrical and hydraulic feeding assemblies and also all the service units which are used for the working of the rolling mill stand itself.

The invention also provides, on the actuation side, means for the quick connection/disconnection of the hydraulic connectors associated with the means performing the axial clamping/release of the chocks to/from the sliding blocks.

According to the invention, at least on the working side the means performing the axial clamping/release of the chocks are positioned in a position external to the relative sliding blocks.

The sensors, therefore, which monitor the position of occurrence of the axial clamping/release may also themselves be positioned at an external position, thus making possible an easy access for maintenance or replacement.

The rolling mill stand to which the device according to the invention is applied is associated with a centralized lubrication system, for instance of an air-oil type.

This centralized lubrication system includes first connector means applied frontally to the terminal surface of the chock on the actuation side of the rolling mill stand, these first connector means being connected to second connector means included on the machine.

The second connector means are connected by hoses to the centralized assembly feeding the lubricating fluid.

The hoses enable these second connectors on the machine to follow the chocks, which are secured axially to the relative sliding blocks, in the axial movements of the chocks during the working step.

These second connector means can also move in a direction transverse to the axis of the working rolls so as to follow the chocks in this transverse movement.

The device according to the invention is embodied, on the actuation side of the rolling mill stand, with an oscillatory lever element which has a first clamping position and a second release position.

In the second release position the oscillatory lever element frees the chock from axial clamping to the relative sliding block and enables the chock to be withdrawn towards the working side of the rolling mill stand so as to enable the working rolls to be replaced or maintained.

The oscillatory lever element in its second release position also clamps transversely the second connector means on the machine, which, as they are no longer secured to the relative chock, could be displaced transversely and therefore be misaligned in relation to the correct installation position.

During the step of installing the chock with the new rolls, the first connector means positioned terminally and frontally on the chock are connected easily and quickly to the second connector means, which have remained clamped transversely in position.

When the coupling has taken place, the oscillatory lever element is brought to the first clamping position in which it secures the chock axially to the relative sliding block.

The oscillatory lever element in the first clamping position frees from constraint the second connector means, which are now solidly coupled to the chock and can follow the movements of the chock in an axial direction and in a direction transverse to the axis of the working rolls.

On the working side of the rolling mill stand a clamping element of a rotary sleeve type is fitted on the front terminal part of the sliding blocks in a position external to the relative sliding block; this rotary sleeve is associated with actuator means and can be rotated in relation to the cylindrical end of the sliding block to which it is axially secured.

The rotary sleeve bears on its circumference in a position at a determined angle at least one first clamping projection.

This first clamping projection cooperates, in a first angular position of the rotary sleeve, with a hollow or abutment present on the stationary block so as to secure the sliding block axially to the stationary block.

In this position the chock is released from the relative sliding block and can be withdrawn axially for the usual operations of replacement of the rolls.

In a second angular position of the rotary sleeve, this position being rotated in relation to the first position, the first clamping projection cooperates with abutment means or with hollow means included on the chock so as to secure the sliding block axially to the chock.

In this second position of the rotary sleeve the chock follows the axial movement imparted to the sliding block so as to displace the working rolls axially during the working steps.

The clamping positions of the rotary sleeve are coordinated with respective longitudinally defined positions of the sliding block, on the one hand in relation to the relative chock and on the other hand in relation to the relative stationary block.

According to a variant the rotary sleeve bears on its circumference at positions defined at an angle to each other at least one first clamping projection and one second clamping projection which are offset from each other by a desired angle.

In a first angular position of the rotary sleeve the first clamping projection cooperates with a hollow or abutment included on the stationary block of the rolling mill stand, thus securing the sliding block axially to the stationary block, while the chock remains axially released.

In a second angular position of the rotary sleeve the second clamping projection secures the chock axially to the sliding block, while the sliding block is released from the relative stationary block.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
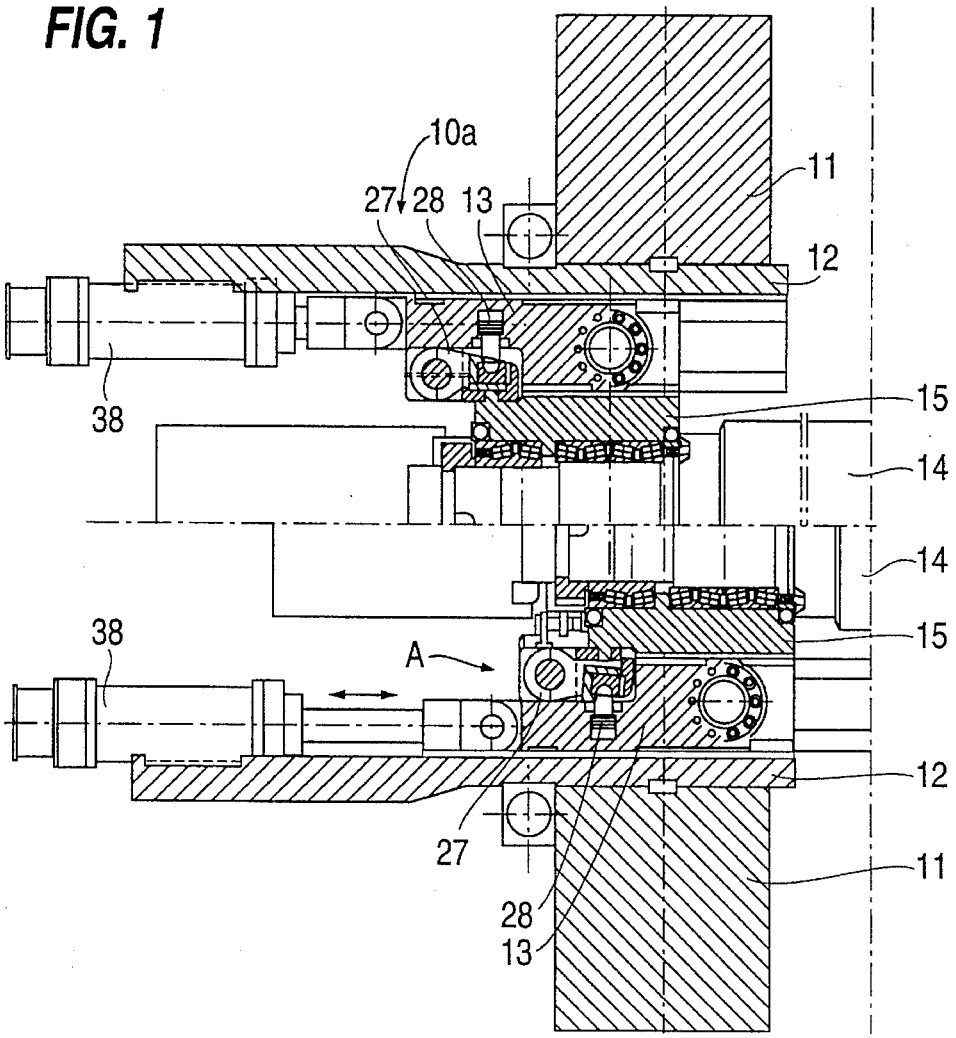
FIG. 1 shows a lengthwise section of the actuation side of a rolling mill stand to which the device according to the invention is fitted.
Figure 2:
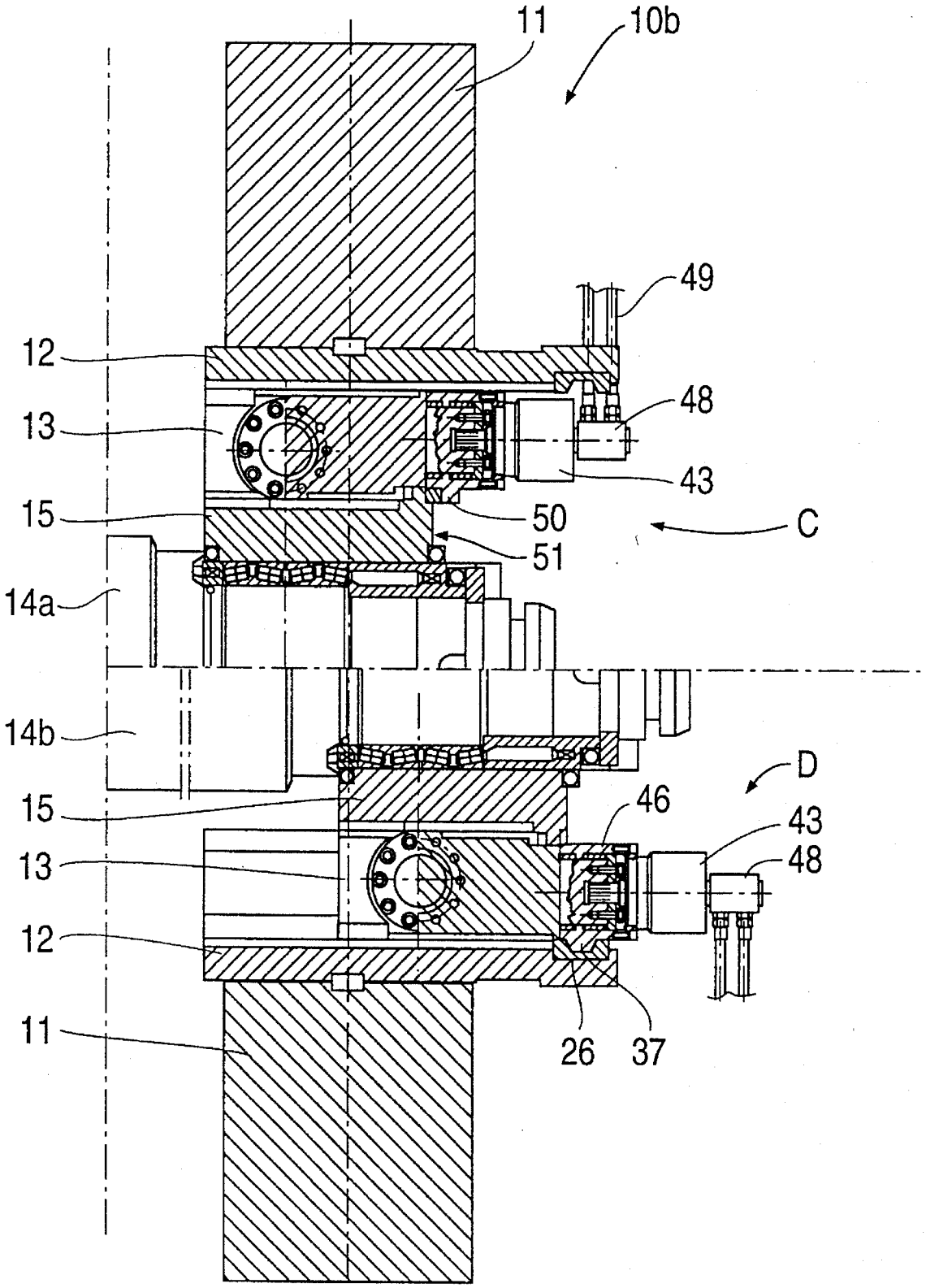
FIG. 2 shows a lengthwise section of the working side of the rolling mill stand.

A rolling mill stand, the actuation side 10*a* of which is shown in FIG. 1 while the working side 10*b* of which is shown in FIG. 2, comprises housings 11 to which are fitted stationary supporting blocks 12, one block per each of two working rolls 14.

Sliding blocks 13 on which displacement jacks 38 act on the actuation side 10*a* cooperate with the stationary supporting blocks 12.

These jacks 38 have the purpose of performing axial displacement of the working rolls 14 during the rolling steps; this axial displacement is carried out during the rolling to displace the working rolls 14 in relation to each other and thus to change the relative working surfaces involved in the rolling action and thereby to make possible a more even distribution of the wear on the surfaces of the rolls 14.

The working rolls 14 are installed on relative chocks 15, which during installation are secured axially to the relative sliding blocks 13 so as to follow those sliding blocks 13 in the axial movement imparted thereto by the jacks 38.

Figure 5:
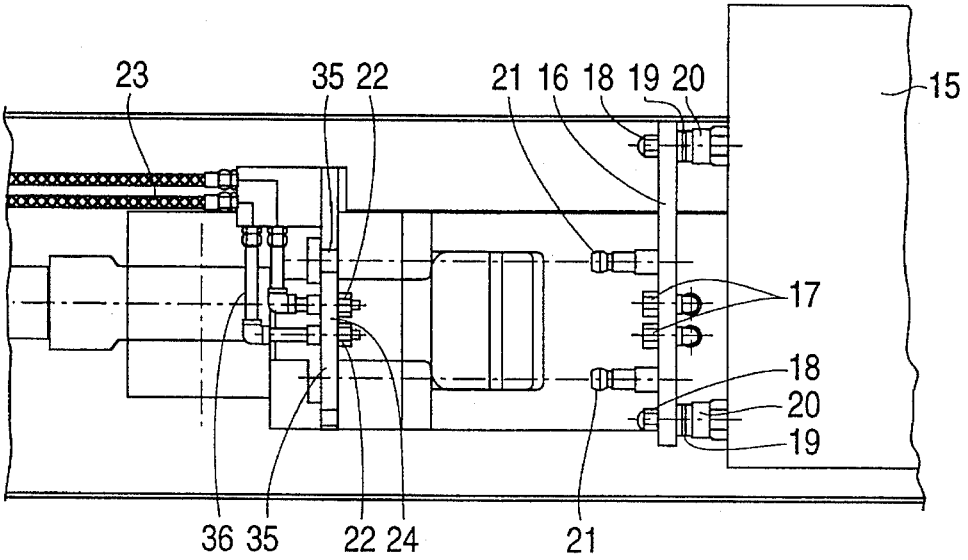
FIG. 5 shows a section along the line B—B of FIG. 4.

The rolling mill stand includes a centralized system to lubricate the bearings of the working rolls 14 by means of female feeder connectors 17 which are included terminally on the front of the chocks 15 and which are connected to mating male connectors 22 on the machine (FIG. 5).

In this case on the actuation side 10*a* of the rolling mill stand the chocks 15 include a first terminal frontal plate 16, which is fitted to the relative chock 15 by means of a pair of pins 18 provided with footstep bearings 19 and thrust springs 20.

The footstep bearings 19 and thrust springs 20 have the purpose of compensating any small misalignments which might occur during installation.

In this case the first plate 16 includes a pair of insertion and alignment pins 21 and a pair of the female connectors 17 to feed the lubricating fluid.

The male connectors 22 are connected to the centralized lubrication system by means of feeder hoses 23 and hydraulic conduits 36.

The male connectors 22 are fitted to a second plate 24, which has an overturned T-shaped section and can move transversely to the axis of the working rolls 14 within a groove 25, which has a mating shape and is machined in the sliding block 13.

The second overturned-T shaped plate 24 is provided with a pair of holes 35, which are shown with their axes drawn with lines of dashes (FIG. 5) and within which the insertion and alignment pins 21 are inserted and clamped pneumatically during installation of the chocks 15.

According to the invention microswitches are included (but not shown) and give warning of the clamping and release of the insertion and alignment pins 21.

Figure 3:
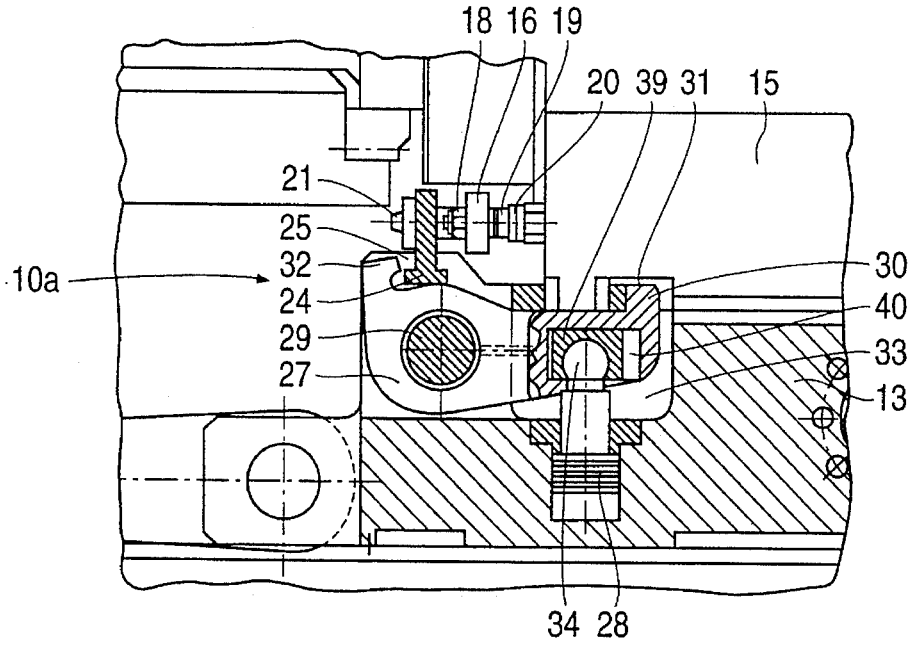
FIG. 3 shows in an enlarged scale the detail "A" of FIG. 1 in the position of axial clamping of the chocks.

The clamping/release device on the actuation side 10*a* according to the invention consists substantially of a lever 27 that can oscillate about a pivot 29 owing to the action of a hydraulic cylinder/piston actuator 28. The oscillatory lever 27 is lodged in a hollow 33 machined in the sliding block 13 and is equipped in this case with a tooth 30 on one side and is conformed as a hook 32 on its other side. The lever 27 has a first closed clamping position (FIG. 3) to clamp the chock 15 and a second open position (FIG. 4) to release the chock 15. In its first closed clamping position the lever 27 secures the chock 15 axially to the relative sliding block 13.

To be more exact, the tooth 30 of the lever 27 in its first closed clamping position is located within a hollow 31 contained in a longitudinally defined position in the chock 15.

The axial constraint provided by the tooth 30 enables the chock 15 to follow the relative sliding block 13 in the axial movement imparted to the latter 13 by the jack 38.

Moreover, in this first clamping position the female connectors 17 are connected to the relative male connectors 22, which in turn can follow the axial movement of the chocks 15 since the overturned-T shaped second plate 24 too is secured axially to the sliding block 13 owing to the presence of the insertion and alignment pins 21 within the holes 35.

Figure 4:
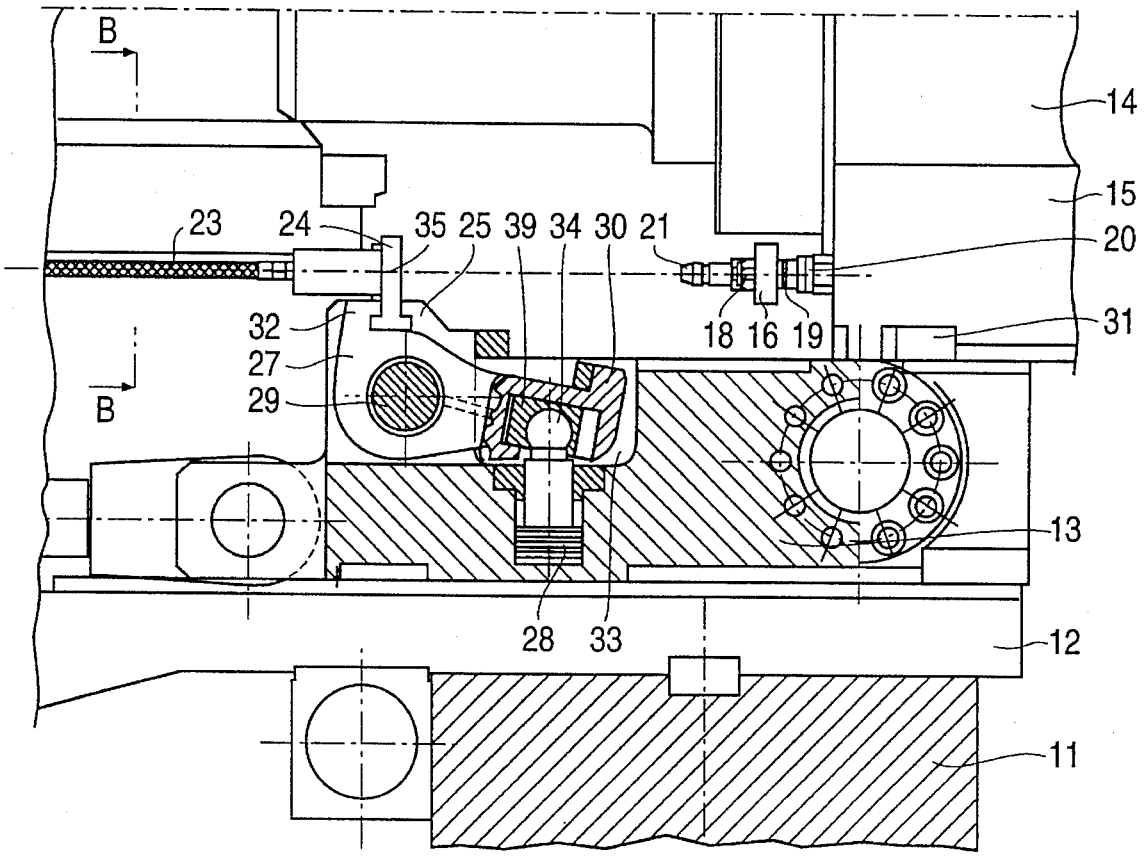
FIG. 4 shows the detail "A" of FIG. 1 in the position of axial release of the chocks.

The axial movement of the overturned-T shaped second plate 24 is made possible by the hoses 23, which are shown only in FIGS. 4 and 5 for the sake of simplicity.

Moreover the male connectors 22 can follow the chocks 15 in the movement of the latter 15 transversely to the lengthwise axis of the sliding blocks 13 inasmuch as the overturned-T shaped second plate 24 can slide transversely within the groove 25 contained in the sliding blocks 13.

When it is necessary to proceed with changing the rolls 14 and therefore with axial withdrawal of the chocks 15, the lever 27 is moved to its second open release position by actuation of the hydraulic cylinder/piston actuator 28.

This hydraulic cylinder/piston actuator 28 has the end 34 of its rod spherical, and a block 39 advantageously made of bronze and inserted into a groove 40 in the lever 27 is associated with that end 34.

Actuation of the hydraulic cylinder/piston actuator 28 causes rotation of the lever 27 about its pivot 29, sliding of the block 39 in the groove 40 and partial rotation of the block 39 itself about the end 34 of the rod.

This rotation of the lever 27 releases the relative tooth 30 from the hollow 31 in the chock 15 and thus enables the chock 15 to be withdrawn axially towards the working side 10*b* of the rolling stand.

At the same time the hook-shaped end 32 of the lever 27 clamps in position the overturned-T shaped second plate 24 bearing the male connectors 22.

In particular the hook-shaped end 32 acts on the ends of the base of the overturned-T shaped second plate 24, and those ends leave the groove 25 in the sliding block 13 (FIG. 4).

In this way the overturned-T shaped second plate 24, which in this position would no longer be wholly constrained since its connection to the chock 15 is lacking, stays clamped in position on the sliding block 13, and therefore the male connectors 22 are thus kept in a position of alignment.

This situation makes the successive installation of the chocks 15 after replacement of the rolls 14 very quick and easy and quick, the connection between the female 17 and male 22 connectors being immediate.

When coupling has been carried out between these connectors 17–22, with insertion of the insertion and alignment pins 21 within the holes 35, the hydraulic cylinder/piston actuator 28 is actuated to bring the tooth 30 of the lever 27 again into the hollow 31.

This tooth 30 secures the chock 15 axially to the sliding block 13 and at the same time frees from constraint the male connectors 22, which can thus follow the axial and/or transverse movements of the chocks 15.

A coordinated axial clamping device is included on the working side 10*b* and makes possible, in a first position, the securing of the chock 15 axially to the relative sliding block 13 and, in a second position, the release of the chock 15 from the sliding block 13, at the same time clamping the sliding block 13 to the relative stationary block 12.

FIG. 2 shows a situation in which the chock 15 of the upper roll 14*a* is clamped axially to the relative sliding block 13 and is therefore in the working step.

Instead, the chock 15 of the lower roll 14*b* is axially free from the relative sliding block 13 and can be withdrawn for replacement of the roll 14 for instance, while the relative sliding block 13 is secured axially .to the stationary block 12.

In this case the cylindrical end 41 of the sliding block 13 contains a space for lodgement of a grooved shaft 42 of an actuator 43, which in this instance is of a hydraulic type.

This cylindrical end 41, moreover, includes holes for fixture of a flange 44 by means of screws 52; this flange 44 acts as an abutment on a bearing 45 of a rotary sleeve 46 and clamps the rotary sleeve 46 axially in relation to the sliding block 13.

The rotary sleeve 46 is solidly fixed by means of screws 47 to the hydraulic actuator 43, which can rotate since it is provided with a rotary joint 48 associated with hydraulic feeder conduits 49.

In this example the rotary sleeve 46 comprises in a circumferential position defined at an angle a first clamping projection 50 jutting out circumferentially and a second clamping projection 37 jutting out circumferentially.

According to a variant which is not shown, the rotary sleeve 46 includes only one clamping projection.

Where there are two clamping projections 50 and 37, these projections are offset from each other at an angle by an angle less than 180° for obvious reasons of non-contact; this angle is advantageously 90°.

The rotary sleeve 46 has a first position defined at an angle, in which it clamps the chock 15 axially to the relative sliding block 13 for the normal working of the rolling cycle (FIG. 6); in this position the sliding block 13 is released from the stationary block 12.

The rotary sleeve 46 has also a second position, in which it secures the sliding block 13 axially to the relative stationary block 12 and at the same time releases the chock 15, which can be withdrawn axially from the relative sliding block 13.

The two clamping positions of the rotary sleeve 46 are coordinated with as many longitudinally defined positions of the sliding block 13, one of these positions in relation to the chock 15 and the other position in relation to the stationary block 12.

To be more exact, the actuation of the hydraulic actuator 43, with the grooved shaft 42 solidly fixed to the sliding block 13, sets the hydraulic actuators 43 itself in rotation.

Figure 6:
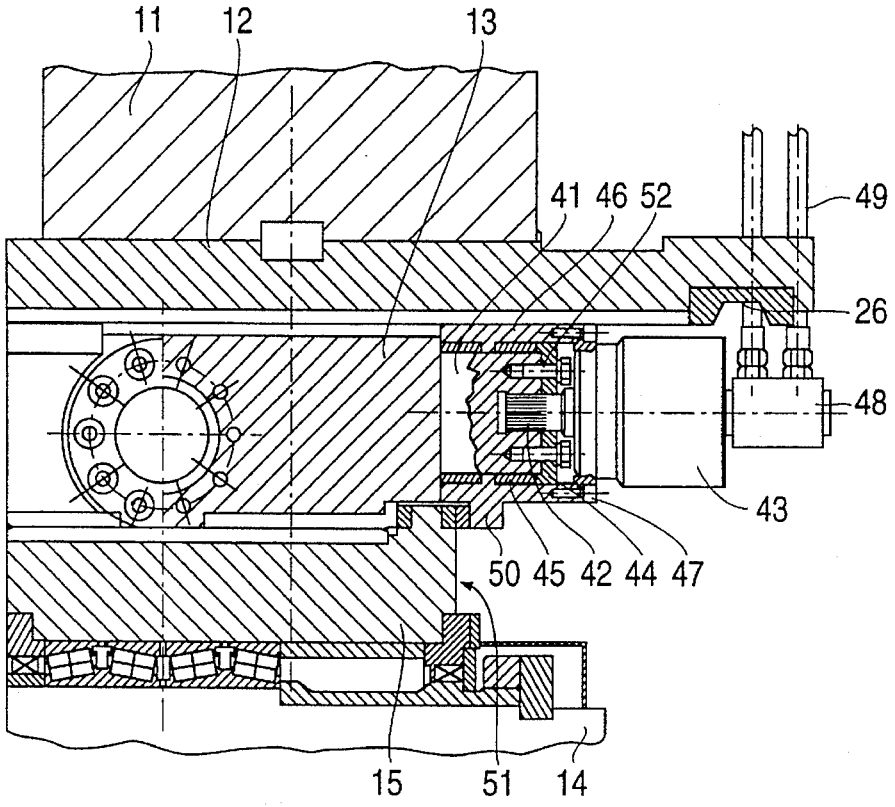
FIG. 6 shows in an enlarged scale the detail "C" of FIG. 2.

Owing to the connection provided by the screws 47 the hydraulic actuator 43 sets in rotation the rotary sleeve 46 and, in the situation of FIG. 6, positions the clamping projection 50 so as to abut against the frontal terminal edge 51 of the chock 15, thus assuring an axial constraint between the chock 15 itself and the sliding block 13.

According to the invention this second position of the rotary sleeve 46 obtained by rotation of the hydraulic actuator 43 releases the chock 15 axially from the relative sliding block 13 and at the same time secures the sliding block 13 to the relative stationary block 12.

Figure 7:
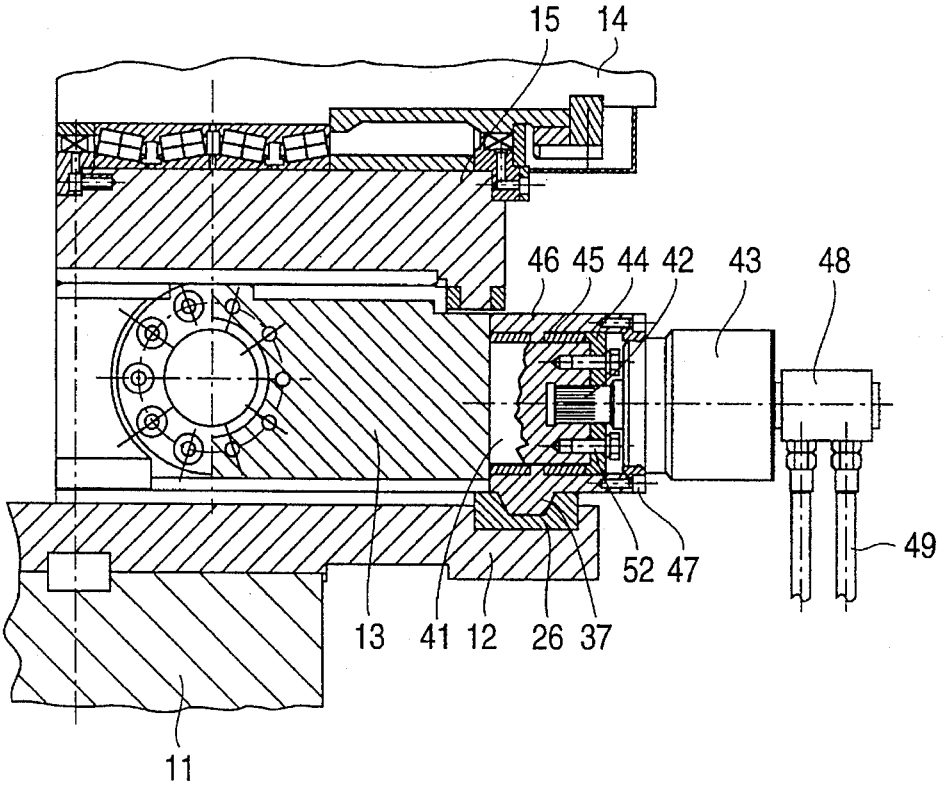
FIG. 7 shows in an enlarged scale the detail "D" of FIG. 2.

So as to provide this axial constraint, the stationary block 12 includes a grooved insertion hollow 26 with which the second clamping projection 37 cooperates in the second position of the rotary sleeve 46 (FIG. 7).

In this position the chock 15 is released and can be withdrawn axially, while the sliding block 13 is secured axially to the relative stationary block 12.

We claim:

1. Device for the axial clamping and release of chocks of working rolls on a rolling mill stand, the rolling mill stand including an actuation side and a working side, stationary housings associated with stationary blocks being comprised at the sides, each of the stationary blocks being associated with a relative sliding block positioned in a direction axial to the working rolls, each sliding block defining a lodgement for a chock, bearings of the working rolls being lubricated with a centralized air-oil system which comprises a first part of connectors located on the device and fixed to supporting means and a second part of connectors included on a front portion of a relative chock, the device being characterised in that the sliding blocks are associated, on the actuation side, with oscillatory means for clamping the sliding blocks to and releasing the sliding blocks from relative chocks, the oscillatory means being able to move from a second position of releasing the relative chock from a relative sliding block to a first clamping position the oscillatory means in the second position acting on the supporting means that support the first part of the connectors so as to clamp transversely the first part of the connectors in a determined position coordinated axially with the position of the second part of the connectors.

2. Device as in claim 1, in which the oscillatory means in the first clamping position cooperate with a lateral hollow contained in the relative chock.

3. Device as in claim 1, in which on the working side a rotary sleeve is included terminally on at least one end of the sliding block, the rotary sleeve having an axis substantially parallel to an axis of a relative roll and being positionable at an angle, the rotary sleeve defining at least one first clamping projection positioned circumferentially at a defined angle, the first clamping projection having at least one first angular position, in which the first clamping projection cooperates with abutment means or with hollow means located at a side of the relative chock, and at least one second angular position in which the first clamping projection cooperates with abutment means or with hollow means located in a side of a stationary block.

4. Device as in claim 3, in which the abutment means or the hollow means is associated with the first clamping projection in a defined lengthwise position of a sliding block.

5. Device as in claim 4, in which the rotary sleeve comprises at least one second clamping projection positioned on a circumference at an angle in relation to the first clamping projection.

6. Device as in claim 3, in which the rotary sleeve is associated with an angular actuator.

7. A rolling mill stand having a working side and an actuation side, comprising:

a first stationary housing supporting a first stationary block provided at the actuation side;

a second stationary housing supporting a second stationary block provided at the working side;

axially extending working rolls installed on chocks and extending between the first and second stationary housings;

a first sliding block slidable axially in the first stationary block, the first sliding block having a lodgement for a chock;

a second sliding block slidable axially in the second sliding block, the second sliding block having a lodgement for a chock;

a centralized air-oil system for lubricating bearings of the working rolls, including a fluid connector having a first part fixed to a support and a second part, releasably connectable with the first part, included on a chock on the actuation side; and a clamp provided on the actuation side, the clamp having a first clamping position for clamping the chock on the actuation side to the first sliding block, and having a second released position releasing the chock from the first sliding block, wherein the clamp, in the second released position, acts on the support for the first part of the fluid connector, to fix the first part of the fluid connector transversely in a position coordinated axially with a position of the second part of the fluid connector.

* * * * *